United States Patent [19]

Stewart

[11] 4,282,809

[45] Aug. 11, 1981

[54] MAILBOX LETTER CANCELER

[76] Inventor: Vernon Stewart, 2146 Sonora, Pomona, Calif. 91767

[21] Appl. No.: 64,718

[22] Filed: Aug. 8, 1979

[51] Int. Cl.[3] ..... B41F 5/00; B41F 31/22

[52] U.S. Cl. ..... 101/212; 101/71; 101/327; 101/367; 101/216; 101/233

[58] Field of Search ..... 101/327–331, 101/367, 212, 216, 71, 90, 233

[56] References Cited

U.S. PATENT DOCUMENTS

| | | | |
|---|---|---|---|
| 147,630 | 2/1874 | Goff et al. | 101/216 |
| 570,994 | 11/1896 | Hargrove | 101/71 |
| 579,960 | 4/1897 | Cochar | 101/71 |
| 632,796 | 9/1899 | Tilly | 101/71 |
| 781,670 | 2/1905 | Malmborg | 101/233 |
| 841,201 | 1/1907 | Wellman | 101/71 |
| 1,069,626 | 8/1913 | Mead | 101/212 |
| 1,087,597 | 2/1914 | Lukens, Jr. | 101/90 |
| 1,109,646 | 9/1914 | Stasiak | 101/71 |
| 1,404,182 | 1/1922 | Anderson | 101/212 |
| 1,596,503 | 8/1926 | Mifsud | 101/301 |
| 1,914,502 | 6/1933 | Heaton | 101/216 |
| 2,099,679 | 11/1937 | Davis et al. | 101/212 |
| 2,369,404 | 2/1945 | Overly | 101/216 |
| 2,470,075 | 5/1949 | Robbins | 101/216 |
| 2,490,902 | 12/1949 | Goodwin | 101/327 |
| 2,763,208 | 9/1956 | Rockoff et al. | 101/367 |
| 3,203,345 | 8/1965 | Gibbons | 101/216 |
| 3,626,844 | 12/1971 | Priesmeyer | 101/327 |
| 3,812,782 | 5/1974 | Furahash | 101/367 |
| 3,885,495 | 5/1975 | Furahash | 101/327 |
| 4,164,744 | 8/1979 | Freude | 101/328 |

*Primary Examiner*—William Pieprz

*Attorney, Agent, or Firm*—Boniard I. Brown

[57] ABSTRACT

A mail canceling device which has at least one canceling die roller pair behind a mail receiving slot therein to cancel the mail as it is inserted into the mailbox. The one or more pairs of rollers can include postmark applying segments as well as canceling dies. The rollers can be provided along opposite edges of the slot. A finger space is positioned centrally in the slot and between the rollers so that the mailer's finger can be used to assure that the envelope or postcard passes completely through the rollers and falls into the storage portion of the mailbox.

7 Claims, 10 Drawing Figures

FIG. 1.
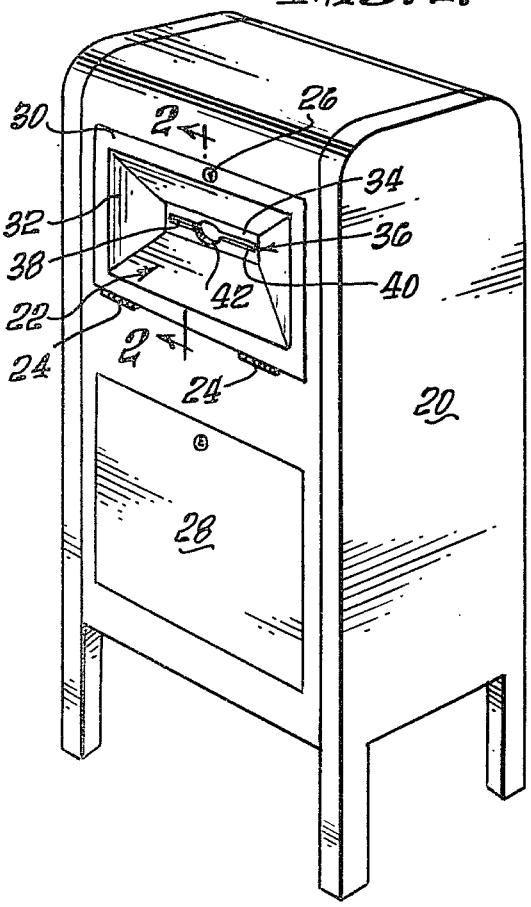
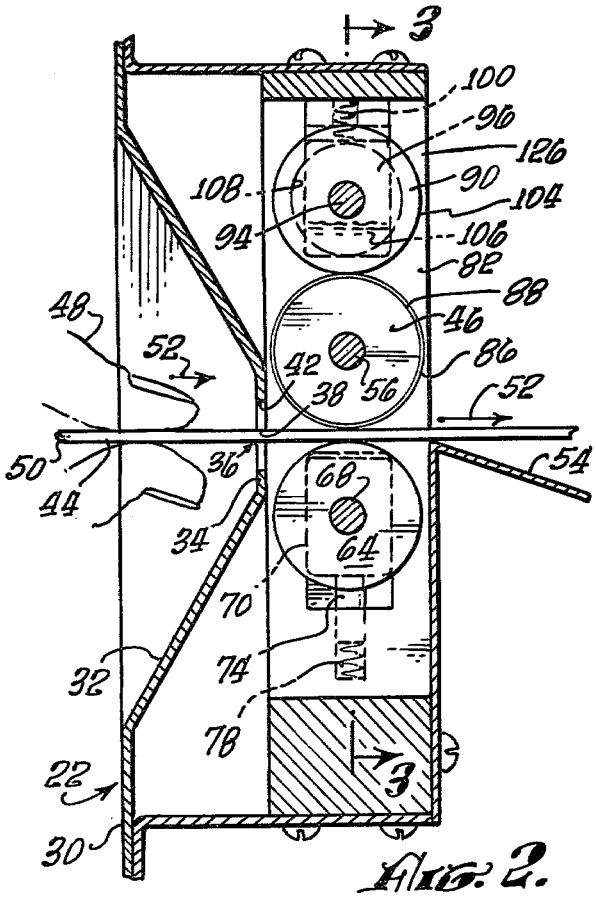
FIG. 2.
FIG. 3.
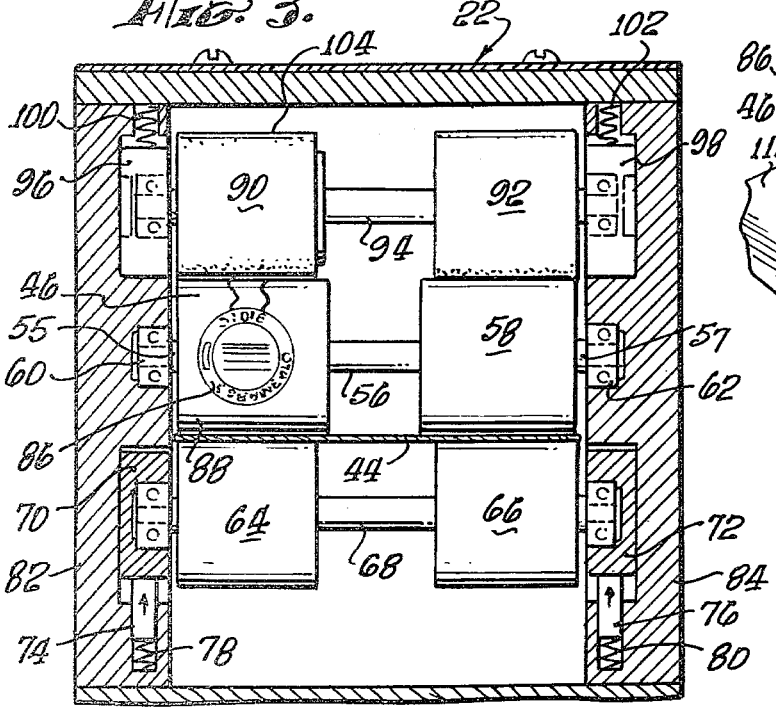
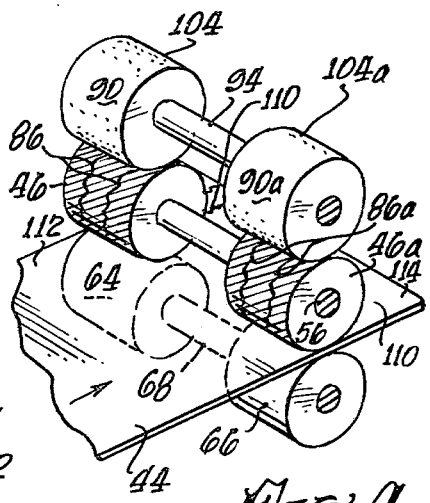
FIG. 4.

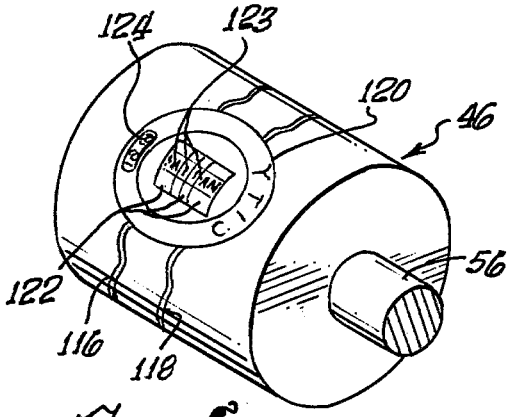
FIG. 5.
FIG. 6.
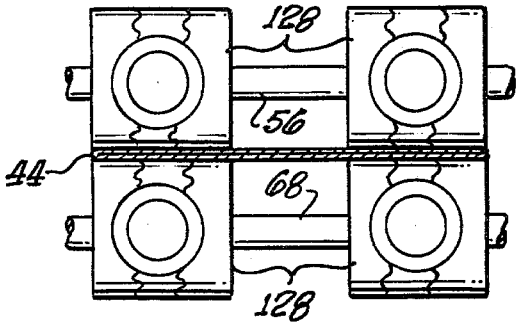
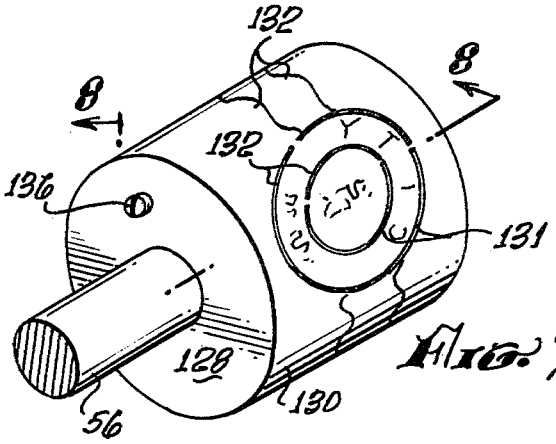
FIG. 7.
FIG. 8.
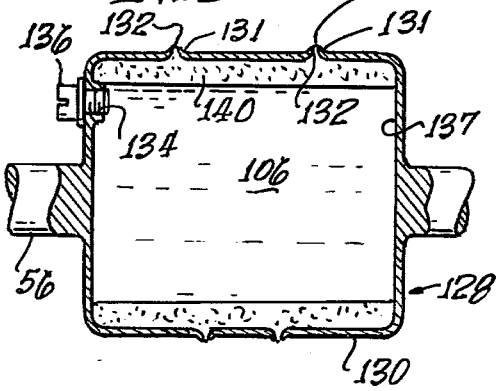
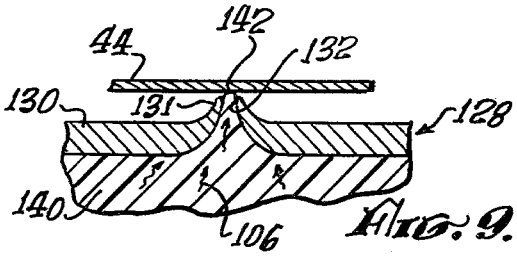
FIG. 9.
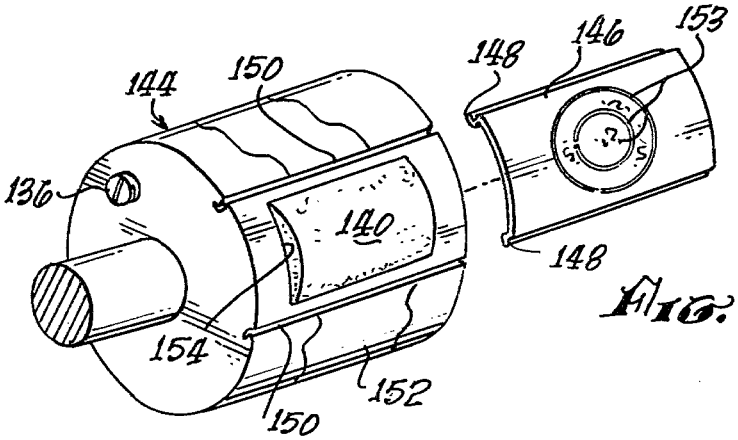
FIG. 10.

MAILBOX LETTER CANCELER

BACKGROUND OF THE INVENTION

Patents such as U.S. Pat. Nos. 575,004 579,960, 632,796, 841,201, 570,994, 1,109,646, 1,404,182 and 1,596,503 show devices for providing a canceling facility in association with a mailbox which in most instances operates as the letter or postcard is being inserted in the mailbox. U.S. Pat. No. 575,004 to McLean on a combined stamp canceling, postmarking and recording mailbox shows a device which postmarks a letter and cancels a stamp as a letter is inserted in the mailbox. The McLean device includes rollers between which the letter moves. Anderson, U.S. Pat. No. 1,404,182 shows a die roller, a felt roller and spring loaded idler support roller which are activated by rack teeth on the mailbox door.

These prior art mailbox stamp cancelling devices have not gained universal acceptance since most are subject to vandalism and jamming or are so complex that they cannot be deployed economically in the numerous existing mailboxes. The prior art cancelers also are subject to operational errors since in most instances, it is required that the mailer insert the letter or postcard in the mailbox with a preferred orientation to assure that the stamp is cancelled thereby.

BRIEF DESCRIPTION OF THE PRESENT INVENTION

The present mail canceler fits in what normally would be the mailing receiving door portion of a mailbox. It has a slot opening in which the mail is inserted for self-cancellation. The canceler usually takes the form of a replacement door for the mailbox which can be locked shut but which can be opened for service or changing of the imprinted dates and times of cancellation. A finger hole is located centrally in the insertion slot. The finger hole allows the customer to push the mail through canceling rollers therebehind while also allowing retrieval of mail which somehow gets jammed and must be reinserted. The canceling rollers can be similiar to those which now are used in postal work. Four of the rollers can be placed so they contact both front and back sides of the mail on the upper and lower portions thereof. This is done when it is desired to assure that all stamps, no matter where they are located, are cancelled. When conventional postal rollers having canceling dies are used, adjacent inking rollers are provided in contact therewith to ink the upstanding portions of the die which then are applied to the mail as it is pushed through the rollers. Non-conventional rollers, such as self-inking rollers, can also be used wherein the ink for cancelling is included in the rollers and is dispensed out through openings either by capillary action or by means of an ink spreading felt or foam placed behind openings in the cylindrical die surface. When this latter type of roller is used, a removeable die plate can be provided on a portion of the canceling roller so that the postmark can be changed at regular intervals.

It therefore is an object of the present invention to provide a simple and economical mailbox letter canceler which has a minimum of moving parts and which can be operated easily by untrained customers.

Another object is to provide an improved cancelling roller for use in self-cancelling mailboxes which can operate unattended for substantial lengths of time.

Another object is to provide a mail canceler which can be retrofitted into existing mailboxes.

Another object is to provide a self-cancelling mailbox which is powered manually by the mere insertion of an envelope into the mailbox.

These and other objects and advantages of the present invention will become apparent to those skilled in the art after considering the following detailed specification which discloses preferred embodiments thereof in conjunction with the accompanying drawings wherein:

BRIEF DESCRIPTION OF THE DRAWINGS

FIG. 1 is perspective view of a mailbox letter canceler constructed according to the present invention installed therein;

FIG. 2 is an enlarged cross-sectional view of the portion of FIG. 1 defined at line 2—2.

FIG. 3 is partial cross-sectional view of the canceler taken at line 3—3 of FIG. 2;

FIG. 4 is diagrammatic representation of a canceling process being performed with the present invention wherein an envelope is being passed through the canceling rollers thereof;

FIG. 5 is an enlarged detail view of a canceling roller having a moveable date and time canceling insert;

FIG. 6 is a diagrammatic representation of a configuration of canceling rollers useful in the present invention wherein both the upper and lower portions of front and back of an envelope are cancelled to assure that the stamp actually is cancelled no matter what the orientation of the envelope;

FIG. 7 is a perspective view of a self-inking roller constructed according to the present invention;

FIG. 8 is a cross-sectional view taken at line 8—8 of FIG. 7;

FIG. 9 is an enlarged detail cross-sectional view of the roller of FIGS. 7 and 8 applying ink to an envelope; and FIG. 10 shows a modified version of the roller of FIGS. 7, 8 and 9 having an removable insert so that the postmark thereof can be changed.

DETAILED DESCRIPTION OF THE SHOWN EMBODIMENTS

Referring to the drawings more particularly by reference numbers, number 20 in FIG. 1 refers to a mailbox having a letter canceler 22 constructed according to the present invention installed in place of the mail inserting door usually provided in such mailboxes 20. The canceler 22 is connected to the mailbox 20 by means of hinges 24 so that when a lock 26 retaining the canceler 22 in the closed position shown in FIG. 1 is unlocked, the canceler 22 is free to swing about the hinges 24 giving access for servicing or maintenance. Such construction also adapts the canceler 22 as a replacement for the conventional door in such mailboxes 20 so that existing mailboxes 20 can have the present invention retrofitted thereto. The mailbox 20, as shown, also includes a mail pickup door 28 which can be opened when it is desired to gather the mail previously deposited in the box 20.

The external appearance of the canceler 22 is that of a frame 30 which surrounds a concave semi-pyramidal portion 32 whose apex is filled by a flat plate 34 having a mail slot 36 defined therethrough. The slot 36 is relatively narrow at its opposite ends 38 and 40 so that it is difficult to insert items other than those which are the size of normal envelopes and postcards. This is to prevent vandalism such as by insertion of noxious items. A finger hole 42 is formed centrally in the slot 36 and consists of a widened portion thereof. The finger hole 42 allows the insertion of an envelope 44 completely past one or more canceling rollers such as roller 46. This is accomplished by placing the finger 48 at the back edge 50 of the envelope 44 so that the envelope 44 can be urged in the direction shown by the arrow 52 past the roller 46 and down the chute 54 which guides the envelope 44 down to a position in the box where it may be retrieved by opening the mail pickup door 28.

As can be seen in FIG. 3, the canceling roller 46 extends behind one end portion 38 of the slot 36 so that a finger 48 pushing the envelope 44 therebelow does not itself receive the same canceling treatment as the envelope 44. In FIGS. 2 and 3 one canceling roller 46 is shown. The canceling roller 46 is mounted for rotation on one end 55 of a shaft 56 whose opposite end 57 supports a guide roller 58. The shaft 56 is mounted in stationary bearings 60 and 62 and therefore cannot move with respect to the slot 36. A pair of pressure rollers 64 and 66 are provided on another shaft 68 in position to bear upwardly toward the rollers 46 and 58 respectively. The shaft 68 is mounted on slideable guide blocks 70 and 72 which are biased upwardly against the rollers 46 and 58 by means of guide pins 74 and 76 which in turn are biased by means of springs 78 and 80. The guide blocks 70 and 72, guide pins 74 and 76 and springs 78 and 80 are restrained in a pair of support members 82 and 84 to which the bearings 60 and 62 of the shaft 56 also are connected. When an envelope 44 is pushed between the rollers 46 and 58, and 64 and 66, the rollers 64 and 66 and the shaft 68 deflect downwardly compressing the springs 78 and 80 so that the envelope 44 is not crushed but instead is pushed with relatively uniform force against the rollers 46 and 58. The canceling roller 46 includes an outwardly extending canceling die 86 about its cylindrical periphery 88 which bears against the envelope 44 being pressed up thereagainst by the pressure roller 64 to apply canceling ink thereto.

The canceling ink is applied to the die 86 by means of an ink roller 90 which is mounted on the opposite side of the roller 46 from the pressure roller 64. The ink roller 90 is mounted with a follower roller 92 on a shaft 94 bearinged to guide blocks 96 and 98 in a fashion similar to the mounting of guide blocks 70 and 72. The guide blocks 96 and 98 are positioned within the support members 82 and 84 and are loaded to bias the rollers 90 and 92 against the rollers 46 and 58 by means of springs 100 and 102.

The ink roller 90 has an outer cylindrical portion 104 of suitable material such as felt or foam to apply some of the ink 106 present in the hollow interior 108 (FIG. 2) thereof onto the die 86 for transfer to envelopes 44 as they pass through the canceler 22. This operation is shown diagrammatically in FIG. 4 which also shows a slightly different configuration of rollers wherein a second canceling die **46*a* is substituted for the guide roller 58 so that cancelation marks 110 are applied to both upper and lower borders 112 and 114 of the envelope 44. Th die 86*a* of the roller 46*a* is inked by the outer portion 104*a* of a second ink roller 90*a* substituted for the follower roller 92**.

The canceling roller 46 can be constructed as shown in FIG. 5 which shows a form available in the prior art. The roller 46 includes wavey radially outwardly extending die portions 116 and 118 which extend around the cylindrical surface 88 thereof about a postmark die portion 120. The postmark die portion 120 includes a number of small rotating cylinders 122 which have date and time indicia 123 on the cylindrical surfaces thereof to allow the date and time imprinted thereby to be changed as desired. The postmark die 120 also includes a year insert 124 which is changed on an annual basis. The roller 46 can be serviced at regular intervals by releasing the lock 26 and swinging the canceler 22 downwardly on the hinges 24 so that access to the roller 46 can be gained from the open rear 126 (FIG. 2) of the canceler 22.

When it is desired to make the canceler 22 cancel any stamp along the periphery of an envelope or postcard no matter what the orientation thereof when inserted in the slot 36, additional canceling rollers can be substituted for the pressure rollers 64 and 66. When canceling rollers such as roller 46 are substituted, additional movement must be provided for the ink rollers therebehind since one or both of the supporting shafts 56 and 68 must be movable to allow for the differences in envelope thickness. This induces additional complications in the mechanism of the ink rollers which additionally must be biased to account for the movement of the canceling rollers and at the same time provide enough movement to assure that the dies are properly inked. Therefore, self-inking die rollers 128 can be provided on the shafts 55 and 68 as shown in FIG. 6 to remove needless complexity.

The self-inking roller 128 as shown in FIGS. 7, 8, 9 and 10 includes an outer cylindrical surface 130 having radially extending ridges 131 with openings 132 formed therethrough. The ridges 131 are formed in the shape of the desired cancelation. The roller 128 is hollow and includes a port 134 which is shown sealable by a bolt 136 through which ink 106 can be inserted into the interior 137 of the roller 128. The inner cylindrical periphery 138 of the roller 128 has a felt or foam ink distributing ring 140 positioned thereagainst. The ring 140 assures that the tips 142 of the openings 132 are furnished a supply of ink 106 for application to the envelopes 44 passing thereagainst.

A modified form 144 of the roller 128 is shown in FIG. 10. The modified roller 144 includes a removable insert 146 which has clip legs 148 adapted to slide and be retained in longitudinal retention slots 150 in the cylindrical surface 152 of the roller 144. The insert 146 has ink openings 153 formed as as the openings 132 in roller 128 through which ink 106 is applied by means of the felt or foam ring 140 which extends through an cutout opening 154 between the slots 150.

Thus there has been shown and described novel mail cancelers for application to mailboxes and improved canceling rollers therefor which fulfill all the objects and advantages sought therefor. Many changes, modifications, variations and other uses and applications of the subject invention will, however, become apparent to those skilled in the art after considering this specification and the accompanying drawings. All such changes, modifications, variations and other uses and applications of the present invention which do not depart from the spirit and scope of the invention are deemed to be covered by the invention which is limited only by the claims which follow.

What is claimed is:

1. A stamp canceler positionable in a mailbox so that the mail is canceled as it is inserted in the mailbox, said canceler including:

a front panel having a narrow slot for receipt of mail defined therein, said defined slot having first and second opposite ends and a finger hole defined centrally therein;

means to connect said canceler to the mailbox;

at least one canceling roller adjacent said first end of said slot and laterally spaced from said finger hole, said at least one canceling roller having a cylindrical surface and a canceling die on said cylindrical surface about the periphery thereof;

at least one pressure roller having a cylindrical surface facing said cylindrical surface of said at least one canceling roller, said at least one canceling roller and said at least one pressure roller being positioned to receive mail inserted through said slot therebetween so the mail is pressured against said canceling die; and means to apply canceling ink to said canceling die, said defined finger hole extending from said front panel to beyond the position the mail is pressured against said canceling die, whereby a finger can push the mail through and out of said canceling and pressure rollers.

2. The stamp canceler as defined in claim 1 further including:

a first shaft mounted parallel to said slot on which said at least one canceling roller is mounted for rotation, said first shaft also including a second canceling roller adjacent said second end of said slot and spaced from said at least one canceling roller; and a second shaft mounted parallel to said slot on which said at least one pressure roller is mounted for rotation, said second shaft also including a second pressure roller adjacent said second end of said slot and spaced from said at least one pressure roller so that a finger gap exists between said rollers behind said finger hole of said slot.

3. The stamp canceler as defined in claim 2 wherein said second shaft includes biased mounting means which urge said pressure rollers toward said canceling rollers, said canceling rollers each including:

an ink containing chamber therein;

radially extending canceling die slit formers on said cylindrical surface thereof; and means to distribute ink from said ink containing chamber to the canceling die slits.

4. The stamp canceler as defined in claim 3 wherein said pressure rollers each include:

an ink containing open chamber therein;

radially extending canceling die slit formers on said cylindrical surface thereof; and means to distribute ink from said ink containing chamber to the canceling die slits.

5. The stamp canceler as defined in claim 4 wherein said cylindrical outer surfaces of said rollers having canceling die slits therein each include:

a cutout in said cylindrical surface thereof; and a clip retaining groove on opposite sides of said cutout, said rollers each further including a die plate having clip legs adapted to be retained in said grooves, whereby said die plate is changable so that the die imprint on the mail can be changed.

6. The stamp canceler as defined in claim 4 wherein said means to distribute ink from said ink containing chamber to the canceling die slits include a felt ring positioned and sized to bear against said slit former from inside said roller.

7. The stamp canceler as defined in claim 4 wherein said means to distribute ink from said ink containing chamber to the canceling die slits include a foam ring positioned and sized to bear against said slit former from inside said roller.

* * * * *